US007431280B2

(12) United States Patent
Stauber et al.

(10) Patent No.: US 7,431,280 B2
(45) Date of Patent: Oct. 7, 2008

(54) METHOD AND DEVICE FOR FORMING GROUPS OF FLAT ARTICLES

(75) Inventors: Hans Stauber, Grüt (CH); Martin Keller, Turbenthal (CH)

(73) Assignee: Ferag AG, Hinwil (CH)

( * ) Notice: Subject to any disclaimer, the term of this patent is extended or adjusted under 35 U.S.C. 154(b) by 241 days.

(21) Appl. No.: 10/499,135

(22) PCT Filed: Aug. 28, 2002

(86) PCT No.: PCT/CH02/00469

§ 371 (c)(1),
(2), (4) Date: Jul. 19, 2004

(87) PCT Pub. No.: WO03/053831

PCT Pub. Date: Jul. 3, 2003

(65) Prior Publication Data

US 2005/0035521 A1 Feb. 17, 2005

(30) Foreign Application Priority Data

Dec. 21, 2001 (CH) ..... 2349/01

(51) Int. Cl.
*B65H 29/68* (2006.01)

(52) U.S. Cl. ..... 271/9.13; 271/69; 271/202; 270/58.01

(58) Field of Classification Search ..... 271/9.13, 271/9.11, 202, 270, 69, 280, 198; 270/58.01, 270/58.23, 58.29, 58.3, 52.03, 58.25, 58.1; 198/644, 418.1
See application file for complete search history.

(56) References Cited

U.S. PATENT DOCUMENTS

| | | | | |
|---|---|---|---|---|
| 3,271,023 | A | 9/1966 | Disbrow et al. | |
| 4,696,464 | A * | 9/1987 | Gammerler | 271/202 |
| 4,886,263 | A * | 12/1989 | Naito | 271/176 |
| 5,421,699 | A * | 6/1995 | Guiles et al. | 414/788 |
| 5,727,781 | A * | 3/1998 | Muller | 270/58.23 |
| 5,992,840 | A * | 11/1999 | Meier | 270/58.29 |
| 6,089,566 | A * | 7/2000 | Xu et al. | 271/265.01 |
| 6,554,274 | B2 * | 4/2003 | Middelberg et al. | 271/225 |
| 6,929,260 | B1 * | 8/2005 | Koelle | 271/167 |

FOREIGN PATENT DOCUMENTS

| | | |
|---|---|---|
| DE | 197 25 605 A1 | 12/1998 |
| DE | 297 24 262 U1 | 9/2000 |

* cited by examiner

*Primary Examiner*—Patrick Mackey
*Assistant Examiner*—Jeremy Severson
(74) *Attorney, Agent, or Firm*—Rankin, Hill & Clark LLP

(57) ABSTRACT

Groups are formed from flat articles being supplied in a plurality of supply streams by combining the supply streams to form a group stream, and by separating article groups from the head end of the group stream through clamping and accelerating aligned leading article edge zones. The supply streams are superimposed in at least one combining point, wherein in all streams to be combined and in all superimposed streams the articles are arranged parallel in a direction transverse to the conveying direction, have the same article spacings, and are conveyed at the same speed. Projections of the streams to be combined and of the superimposed streams on a plane parallel to the parallel alignment of the articles run parallel to one another or coincide. Projections of the streams to be combined on a plane transverse to the parallel alignment of the articles run together at an acute angle.

9 Claims, 4 Drawing Sheets

METHOD AND DEVICE FOR FORMING GROUPS OF FLAT ARTICLES

BACKGROUND OF THE INVENTION

The invention is situated in the field of piece goods conveyance and processing and it relates to a method and a device in accordance with the generic terms of the corresponding independent claims. Method and the device according to the invention serve for forming groups of flat articles, in particular of printed products, wherein the flat articles are supplied in a plurality of substantially continuous streams, wherein every group being conveyed away usually contains one article from every supply stream and wherein the flat articles in each group are arranged in a stack-like manner.

Group formation as mentioned is a frequently used step during further processing of products being produced by printing machines. For example, signatures are collated to form such groups (each group representing one book) or other printed product parts being produced in separate printing processes, or finished printed products to be combined into shipping units or enclosures to be inserted into a main product. Usually, products differing from one another are collated in such groups and there is one supply stream for each product type.

In accordance with prior art, stack-shaped groups of printed products are formed along a collating stretch. The groups or stacks under formation are conveyed along the collating stretch one behind the other lying on a substantially horizontal support or being accommodated in conveying compartments, in which the flat articles are leant against an inclined wall. In this manner, the groups or stacks being produced are transported past feed points, wherein at every feed point a supply stream merges into the collating stretch and usually at every feed point a printed product is added to each group being transported past.

It is obvious, that conveying the stacks or groups under creation one behind the other on a substantially horizontal conveying surface can be implemented with simple devices, for example, with a conveyor belt comprising simple compartments following one another in the conveying direction. It is also obvious, however, that this type of collating stretch becomes relatively long, the length of the stretch being dependent on the largest formats of the printed products to be handled and on the number of feed points. Furthermore, supply of the printed products to stacks being transported one behind the other is easy to implement, for example, directly from imbricated streams, in which the printed products are supplied with their leading edges positioned on the upper stream surface and for each supply step the article forming the front end of the stream is pushed or falls downwards on to the stack being transported past. If, however, with installations of the named kind high capacities are to be achieved, high conveying speeds along the collating stretch become necessary, which is disadvantageous with respect to the energy required. Furthermore, strong air currents are created and necessitate in particular for light articles of relatively large formats, holding of the stacks during conveyance, and therefore releasing them for every further addition of a product.

The second, above mentioned method, in which the collated printed products are leaning in conveying compartments (lying stacks) constitutes an attempt to avoid the mentioned difficulties. The expanse in conveying direction of these conveying compartments is limited not by the largest product format to be expected, but rather by the largest stack height (sum total of the thicknesses of the printed products stacked in each group) to be expected, which for most applications is significantly smaller than the two-dimensional product expanse (format). However, to be added to the groups, the printed products have to be introduced into the conveying compartments, i.e. between the stacks. For this purpose, the products are usually conveyed, each one being held gripped at an upper edge by a gripper and are introduced into the conveying compartments from above, i.e. with the unguided, lower edge leading. If, for shortening the collating stretch, the conveying compartments are as narrow as possible, space for supplying the products is small and the supply action needs to be correspondingly precise. This on the one hand calls for a low relative speed between the conveying compartment and the article to be added and therefore for a relatively long supply stretch and for a limited absolute speed of the printed product to be supplied, such that the unguided edge being the leading edge during the supply operation is not displaced in an uncontrolled manner by the air current. From the above follows, that the second one of the above described methods requires significantly more expensive mechanical means and therefore, can only solve the above mentioned problems partially.

A combination of simplicity with respect to the needed device and a short, i.e., space saving collating stretch (tight stack arrangement and close succession of feed points) is conceivable, if the stacks overlap one another, i.e., if they are trans-ported in the manner of an imbricated stream of stacks, i.e. in a stream which lies on a substantially horizontal conveying surface and in which every scale comprises a plurality of articles lying one on top of the other (stacked). Solutions in this direction are described in the publications DE-3145491 (or U.S. Pat. No. 4,471,953) and DE-19643395 (or U.S. Pat. No. 5,727,781).

In accordance with DE-3145491, the stacks overlapping one another are transported along the collating stretch with the help of stack grippers, which act on the trailing stack sides, wherein the articles of a succeeding stack may cover a downstream stack gripper. For adding a further article to a stack being transported in the named manner, the corresponding stack gripper is opened towards the top and thereby the articles of the succeeding stack, which are covering the gripper are lifted. The articles to be deposited on the stacks are supplied in a supply direction and being individually held gripped at upper, leading edges. Therein the supply direction is parallel to the conveying direction of the collating stretch and the supply speed is lower than the speed of the imbricated stacks along the collating stretch. The article supply is controlled in such a manner, that the unguided trailing edge of an article to be added to a stack is positioned on a guide surface or on an already stacked article and as a result of the speed difference is pushed into the stack gripper and therewith underneath the lifted articles of the succeeding stack. As soon as the trailing edge of the article makes contact with the gripper body, i.e. is aligned with the trailing edges of articles already stacked in the stack gripper, the supply gripper is opened and the stack gripper is closed.

The above description demonstrates, that in accordance with DE-3145491 a relatively simple stack conveyance with small stack spacings becomes possible. However, it is not possible to arrange the feed points very closely following one another in the direction of stack conveyance, the device is expensive and the feed points have to be equipped in dependence of article format.

Publication DE-19643395 also describes a collating method based on the idea of an imbricated stack stream. The rectangular, or if so applicable, square printed products to be supplied at a feed point are not really positioned on a stack being transported past the feed point, but they are rather laid, in the form of an imbricated stream, on a group stream comprising one or several imbricated streams. Therein, in all superimposed, imbricated streams, scale spacings are the same and leading zones of the printed products belonging to the same group are aligned to one another but are separated from one another by trailing zones of printed products of preceding groups. At a head end of such an imbricated group stream, where leading zones of printed products belonging to a front-most group are positioned on top of one another (there is no preceding group, the articles of which are lying in between), these leading zones are gripped and accelerated, as a result of which the front-most group is pulled out of the stream as a stack and is separated from the stream.

For an unproblematic group separation, DE-19643395 proposes to laterally guide the stacks being pre-formed in the group stream, in order to align the printed products which belong to a specific group to be formed, but which belong to different ones of the superimposed imbricated streams. For making such guidance possible, in the group stream, the printed products are arranged diagonally, i.e., with a leading corner. The longitudinal edges of a group stream of such diagonally arranged, rectangular or square printed products are not straight, but serrated, so that the individual scales or groups respectively can be guided in the region of their edges being arranged on both stream sides by guide means acting at the serrations (e.g., guide pins being conveyed together with the stream).

The printed products to be supplied to the group stream with a diagonal imbricated arrangement are supplied in supply streams, in which the product edges are aligned perpendicular and parallel to the conveying direction and which meet the stack stream at a slant where every printed product is deviated into the direction of the diagonal conveyance for being positioned on the group stream. For such deviation, forces have to be applied to the printed products, which forces are absorbed by the guide pins.

The position of the guide pins has to be adapted to the largest expected format of printed products to be stacked and to the scale spacing. All products with a smaller format are aligned to one or the other of the guided corners depending on the supply direction and they are guided on one side only. Very small products if so applicable remain completely unguided. Supply is only possible from above and it is a condition that in the supply streams the leading product edges are located on the upper stream side.

The object of the invention is to create a method and a device, which serve for forming groups of flat articles supplied in supply streams and which, like the system according to DE-19643395, are based on a group stream comprising a plurality of superimposed, imbricated streams. The method and the device according to the invention, however, shall bring improvements over the prior art not only with respect to independence of the format, to flexibility and to simplicity with respect to the devices, but also with regard to the shortness of the collating stretch. In particular, the alignment of the articles in the groups to be created shall be much less fixedly predefined by the method or by the device, but shall to a great extent be adaptable to the characteristics of the articles and to the stability of the stacks.

BRIEF SUMMARY OF THE INVENTION

In accordance with the invention, the flat articles to be formed into groups, are supplied in supply streams, the supply streams are brought together to form a group stream comprising a plurality of superimposed, imbricated streams, and from the head end of the group stream, groups are separated in succession by gripping leading article zones lying on top of one another and by accelerating the gripped articles in substantially the same way as described in DE-19643395. However, the articles in the supply streams are arranged relative to the conveying direction and with regard to the distance between them in the same way, as they are to be arranged in the group stream. Therefore, the supply streams can be brought together substantially without change of direction parallel to the principal surfaces of the articles. This means, that at the feed points no substantial forces are acting on the flat articles, in particular no forces, which would impair the relative arrangement of the articles in these streams. For this reason, it is not necessary to laterally guide the flat articles in the supply streams when they are brought together to form the group stream.

The group stream and the supply streams are transported on corresponding conveying surfaces. At least immediately upstream of a feed point, where a supply stream merges into the group stream (or into another supply stream), the conveying surfaces and with this the articles of the supply stream and the articles of the group stream are, in a direction transverse to the conveying direction, arranged parallel to one another. The projections of the streams onto a plane being parallel to the mentioned parallel alignment of the conveying surfaces run parallel or coincide and the projections of the streams onto a plane being vertical to the parallel alignment of the conveying surfaces run towards one another at an acute angle. In all participating streams, the spacings between articles (scale spacing) and the speed are the same and for the bringing together it is taken care of with suitable means, that the streams are in phase in such a manner, that leading edge zones of the articles of different imbricated streams are aligned to one another in the group stream.

At the head end of the group stream, the leading edge zones are gripped and accelerated by a clamping and accelerating means acting if possible over the whole width of the group stream, while the articles of at least one next group are pressed in such a manner, that they are not accelerated together with the group to be separated and therefore are not displaced relative to the group stream.

In contrast to the system disclosed in DE-19643395, the invention makes it possible to bring together into groups articles with other than rectangular or square shapes and with alignments relative to one another which are freely selectable within wide limits, and it makes it possible, to arrange the articles in the groups not only on top of one another (stacked), but also next to one another or in part on top of one another and in part next to one another. As long as the width of the supporting surfaces is sufficient, format changes are possible without any conversion of devices.

It is therefore possible to produce stable groups from differently sized, differently thick and differently stiff articles. In the imbricated supply streams, the articles can be conveyed with their leading edges positioned in the lower or upper stream surface and can be brought towards the group stream from either side (from below or from above). From these characteristics the method according to the invention does not only get the demanded independence of the article format and the article flexibility, but also the possibility of a very close feed point arrangement, which in turn leads to a very short "collating stretch".

The device for carrying out the method according to the invention is capable of being implemented with the most simple means, for example, with a system of conveyor belts and/or pairs of conveyor belts, which system is equipped for bringing together the supply streams. The device further comprises a pressing means arranged at the head end of the group stream, just upstream of the separating point, as well as a separating means acting at the separating point, wherein both the pressing means and the separating means may be designed as pairs of conveyor belts arranged to be pressed against one another. All conveying means upstream of the separating point have the same first speed. The clamping and accelerating means has a speed which is greater than the first speed, and which is adapted to the ratio of the length of the articles in conveying direction to the scale spacings.

The method and the device according to the invention are described in detail on the basis of the following Figs.

DETAILED DESCRIPTION OF THE INVENTION

Figure 1:
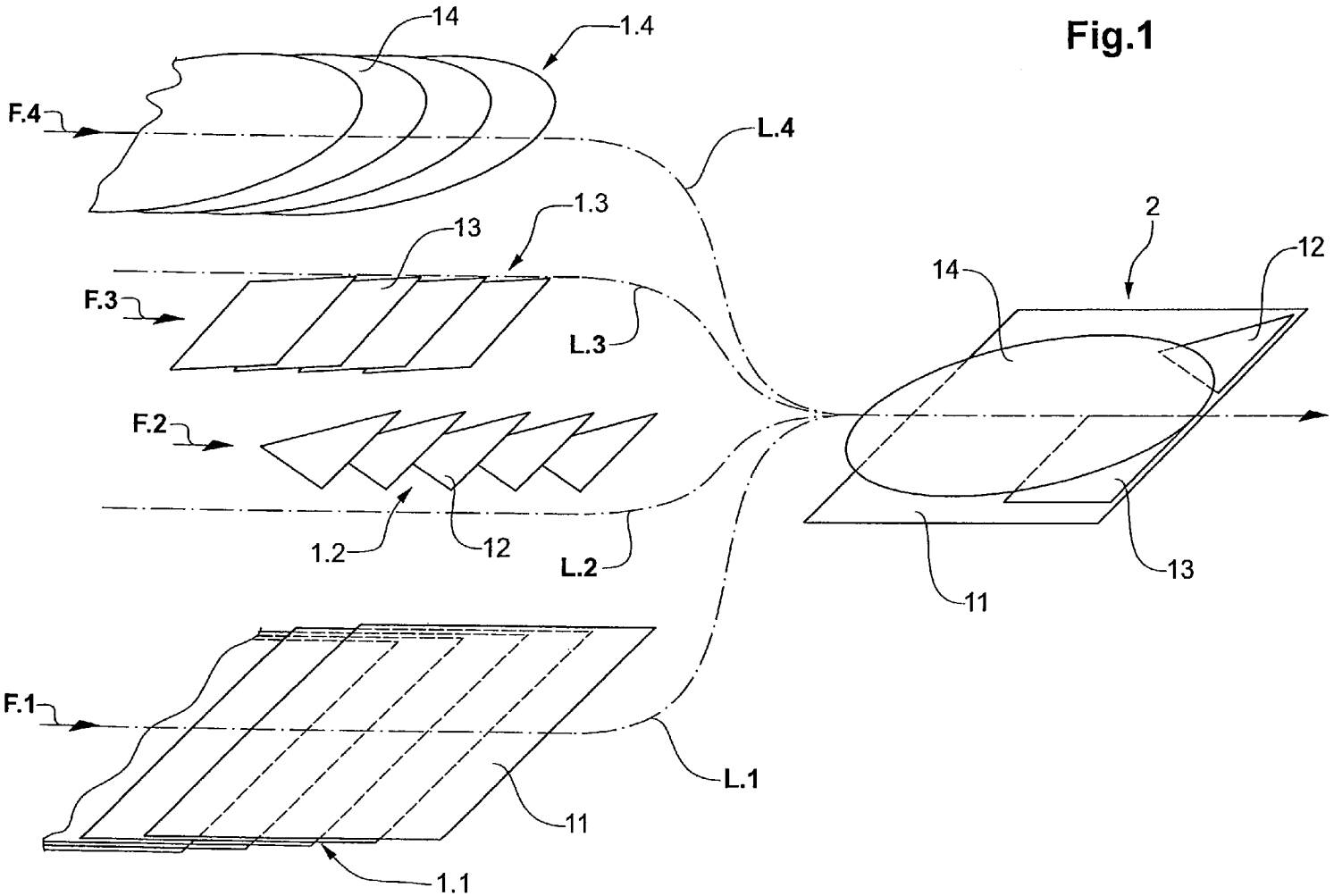
FIG. 1 is a schematic representation of a plurality of feed streams of different sized flat articles with different formats and a group formed from the articles.

FIG. 1 illustrates parts of four exemplary supply streams 1.1, 1.2, 1.3 and 1.4 of four different types of flat articles 11, 12, 13 and 14. The supply streams are illustrated in an arrangement as demanded by the method according to the invention for forming a (not illustrated) group stream. Also illustrated is a group 2 separated from the group stream, the group comprising one article 11, 12, 13 and 14 of each supply stream 1.1 to 1.4 and within the group, leading edge zones of the articles being aligned to one another and the lateral arrangement of the articles in the group corresponding to the relative arrangement of the supply streams prior to the bringing together.

The arrows F.1, F.2, F.3 and F.4 and the dot-dash line L.1 indicate the conveying directions of the imbricated streams (aligned to the centres of gravity of the articles), the dot-dash lines L.2 to L.4 are projections of the dot-dash line L.1 onto the conveying path of the supply streams F.2 to F.4. For illustrating independence of the method according to the invention on article format and on article flexibility, the articles 11 of the supply stream 1.1 are shown to be rectangular, the articles 12 of the supply stream 1.2 are triangular, the articles 13 of the supply 1.3 are rectangular and the articles 14 of the supply stream 1.4 are round. All supply streams 1.1 to 1.4 are imbricated streams (distance between the articles smaller than the length of the articles in the conveying direction). In the supply stream 1.1, the leading edge zones are positioned on the bottom side, in the other supply streams they are lying on the top side. In all four supply streams, the articles are substantially lying in planes trans-verse to the paper plane of the figure and the conveying directions run parallel to this paper plane. For the not illustrated bringing together operations, the directions of conveyance still running in parallel to the paper plane are brought together at an acute angle as indicated by the dot-dash lines L.1 to L.4, while the articles are still lying in planes transverse to the paper plane.

In all supply streams, the leading edge zones of the articles have the same distances between one another (scale spacing) and the supply streams are coordinated (synchronised) with one another in such a manner, that the leading edge zones of the articles of the supply streams being brought together are positioned substantially one above the other.

In group 2, articles 12 and 13 are lying eccentrically between articles 11 and 14. This is achieved by a displacement of the supply streams 1.2 and 1.3 trans-verse to the conveying direction (distance between arrow F.2 and dot-dash line L.2 or between arrow F.3 and dot-dash line L.3 respectively). It is obvious, that the method according to the invention does not restrict in any way the format of the articles to be brought together in the groups, nor their relative, lateral arrangement in the groups (arrangement transverse to the direction of conveyance). The only condition is the fact, that leading edge zones of articles belonging to one group need to be substantially aligned to one another (with such an accuracy, that they can be gripped together for group separation).

Figure 2:
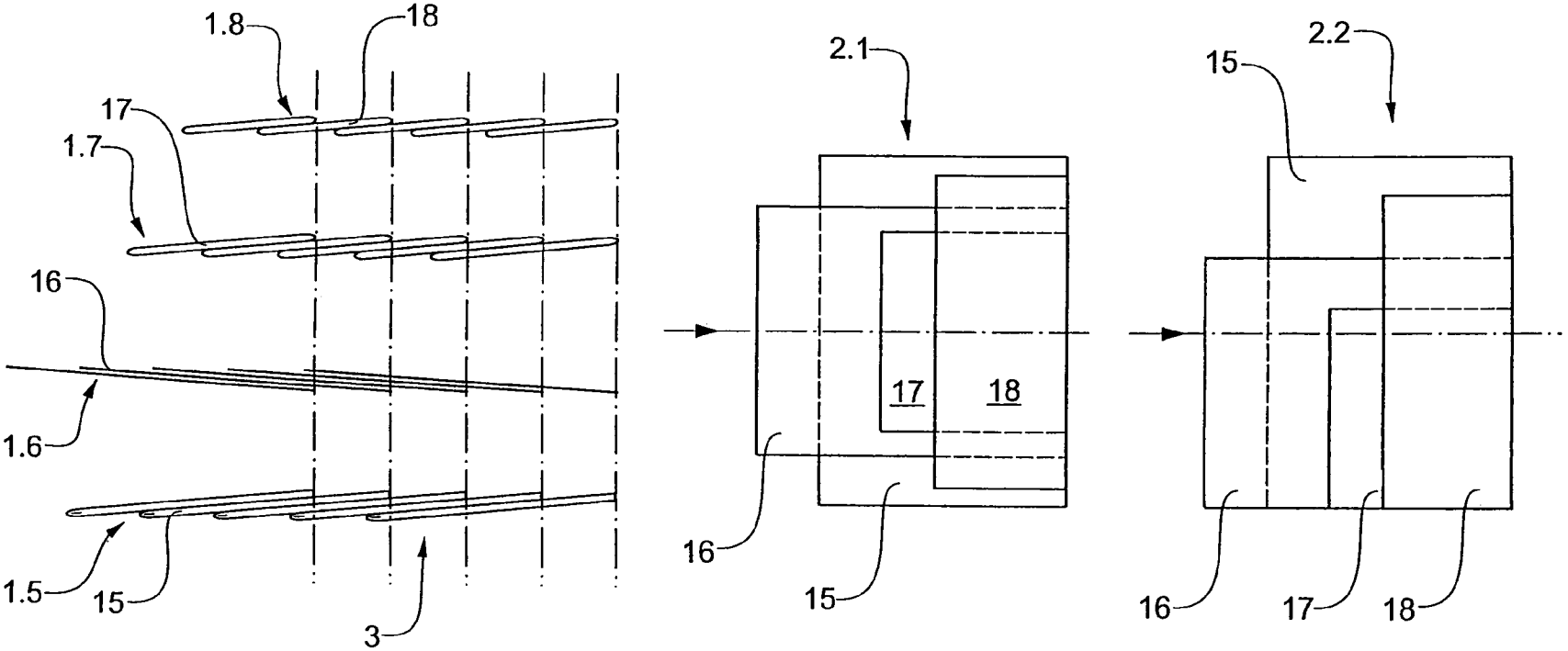
FIG. 2 is a schematic representation of a further plurality of imbricated streams of rectangular and square, flat articles and two groups formed from the articles.

FIG. 2 shows a section of a group stream 3 of four superimposed supply streams 1.5 to 1.8 (articles arranged transverse to the paper plane), wherein the supply streams comprise different sized rectangular and flat articles 15 to 18. The supply streams which in reality lie directly one on top of the other in the group stream are shown in FIG. 2 with a distance between one another. The alignment of the leading article edge zones in all supply streams is clearly evident from this illustration. Furthermore, FIG. 2 illustrates two exemplary groups 2.1 and 2.2 possibly preformed in the group stream 3 depending on the lateral alignment of the supply streams. In both groups, the leading article edges are aligned to one another. In group 2.1, the articles 15 to 18 are arranged on a common centre line, in group 2.2, they have one aligned lateral edge.

Figure 3:
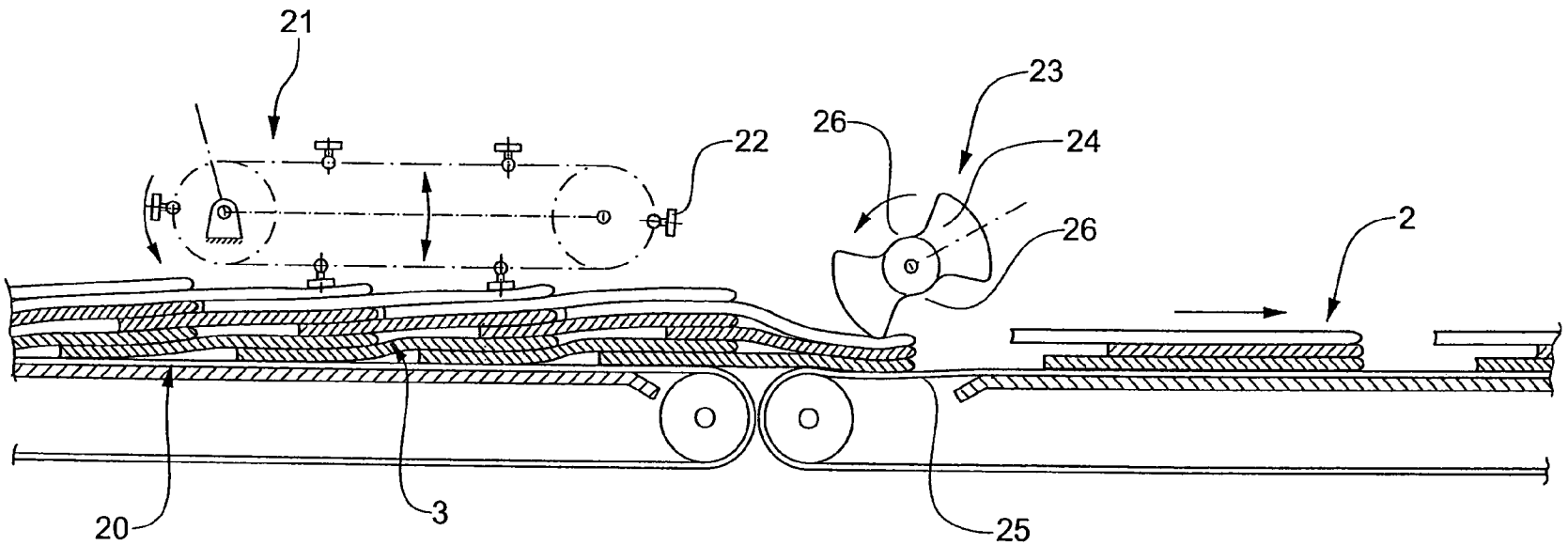
FIG. 3 is a side elevated view of parts of an exemplary embodiment of the device according to the invention for separating groups from the head end of the group stream (section parallel to the conveying direction)

FIG. 3 shows (again in section parallel to the conveying direction) those components of an exemplary embodiment of the device according to the invention, which are arranged in the area of the head end of group stream 3 and which essentially serve for separating groups 2 from this head end. The group stream is conveyed towards its head end on a conveying surface 20. Immediately upstream of the head end of the group stream 3, a pressing means 21 is provided, for example, pressing elements 22 travelling along with the group stream at a distance between each other which corresponds to the scale spacing in the group stream 3 and pressing the group stream against the conveying surface 20.

At the head end of group stream 3, a clamping and accelerating means 23 is provided for separating the groups from the head end. The clamping and accelerating means is, for example, a pressing wheel 24, arranged to co-operate with a conveying-away surface 25 and comprising recesses 26 at its circumference in such a manner, that in rotation it generates a rhythmic sequence of pressing steps alternating with pressing pauses. During the pressing steps the circumference of the pressing wheel is pressed against the conveying-away surface 25. Instead of the pressing wheel 26, it is also possible to provide grippers to be conveyed past the head end of the group stream 3 one after the other, each one grasping the frontmost group such taking over the function of the clamping and accelerating means.

The conveying-away surface 25 and the pressing circumferential parts of the pressing wheel 26 have in operation the same speed, which is at least so much higher than the speed of the group stream 3 or of the conveying surface 20 or of the pressing elements 21 respectively, that a group to be separated 2 in one conveying clock cycle is conveyed far enough for the trailing edge of even the longest (in conveying direction) article in the group to be pulled out of the group stream 3. While the group stream 3 is conveyed by one scale spacing in each conveying clock cycle, the separated groups need to be conveyed by at least the length of the group in conveying direction in each conveying clock cycle. The rhythm of the pressing steps is to be matched to the scale spacing in the group stream 3.

The distance between the downstream end of the pressing action of the pressing means and the head end of the group stream 3 is advantageously selected in such a manner, that the trailing zones of the articles of a group which is to be separated from the head end are not subjected to this action.

The clamping force to be generated by the clamping and accelerating means is sufficiently great to pull the articles of the front-most group out of the group stream 3, if at all possible without slippage. The pressing force to be generated between the pressing means 21 and the conveying surface 20 is great enough for pre-venting displacement of articles not belonging to a group which is presently separated from the group stream. Such displacement is caused by friction between articles in the imbricated streams and between the imbricated streams.

Figure 4:
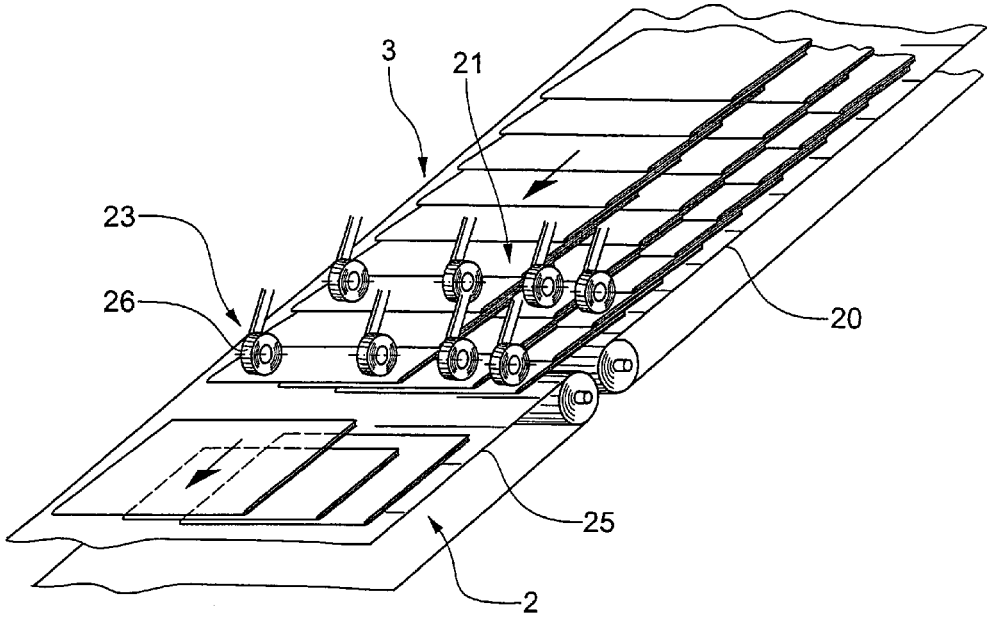
FIG. 4 is a perspective view of components of the device according to FIG. 3 in a schematic three-dimensional representation further showing a group stream, in which the flat articles are arranged to be laterally displaced relative to one another, i.e., aligned neither to a centre line nor to a lateral edge.

FIG. 4 is a schematic, three-dimensional depiction of the pressing means 21 for pressing the head end of the group stream 3 against the conveying surface 20 and of the clamping and accelerating means 23 for separating groups 2 from the head end of the group stream 3. Both means advantageously are effective over the whole width of the group stream 3. They consist, for example as depicted, of rows of pressing elements and rows of clamping and accelerating elements arranged transverse to the conveying direction. The elements are designed for acting substantially independently of the local thickness of the group stream 3 or of the group 2 (e.g., pressing against the conveying surface). All these elements advantageously are capable of being displaced transverse to the conveying direction, i.e. adjustable e.g. in such a manner, that they do not act on article edges.

The articles of group 2 as illustrated in FIG. 4 are laterally displaced relative to one another. This means, that they are aligned neither to a common centre line nor to a common longitudinal edge, as is shown in FIG. 2. such a laterally displaced arrangement makes it indispensable that both the pressing means as well as the clamping and accelerating means if at all possible are effective over the whole width of the group stream. With a laterally displaced arrangement of this kind, however, it is possible to provide for the groups having an as uniform as possible thickness over the width and that, for example, thick folded edges cannot destabilize superimposed articles.

Separation of the groups from the head end of the group stream may have the same direction as conveyance of the group stream towards its head end or it may run at an angle to this conveying direction.

Figure 5:
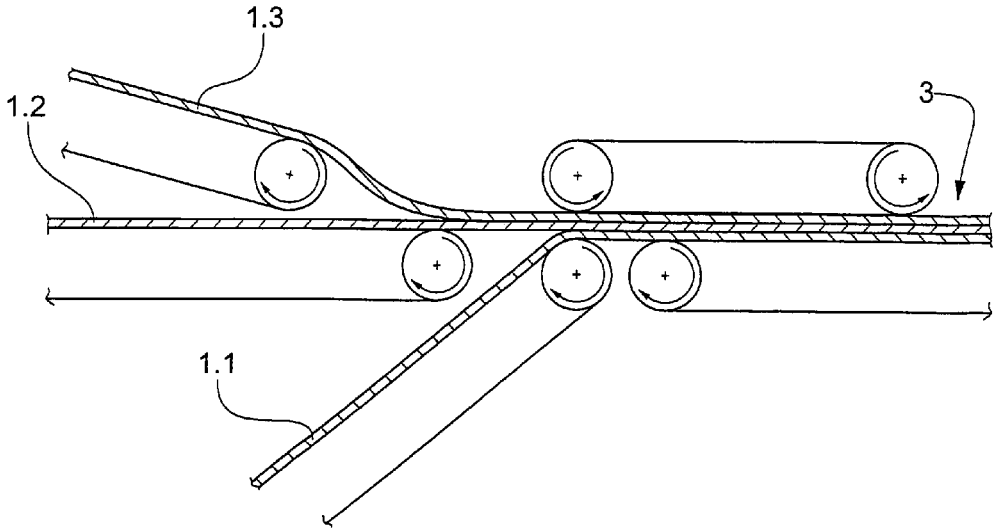
FIG. 5 is a side elevational view of an exemplary embodiment of the device according to the invention for bringing together a plurality of supply streams to form a group stream.

FIG. 5 is a very schematic section (parallel to the conveying direction) of the components of an exemplary embodiment of the device according to the invention, which device serves for combining supply streams (1.1 to 1.3) to form a group stream 3. These components are simple conveyor belts and conveyor belt pairs capable of being pressed against one another. FIG. 5 illustrates how close together the combining points can be arranged in a device of this kind.

The invention claimed is:

1. A method for forming groups of flat articles having at least partly differing sizes, the method comprising the steps of:

supplying the articles in a plurality of imbricated supply streams, all supply streams having the same scale spacings and the same conveying speed;

combining the supply streams at least one combining point by superimposing them to form an imbricated group stream having the same conveying speed as the supply streams, wherein on combining, the supply streams are synchronized such that leading edge zones of superimposed articles of all supply streams are aligned with each other in the group stream;

wherein when viewed from above, respective lines, defined by the direction of travel of each supply stream, are parallel to each other and to the line defined by the direction of travel of the group stream at the combining point;

wherein when viewed from the side, the lines defined by the direction of travel of each supply stream extend toward and have an acute angle with respect to a line defined by the direction of travel of the group stream at the combining point; and at least in a part of each of the imbricated supply streams and imbricated group stream the articles are conveyed with leading edges aligned transverse to the conveying direction of the imbricated group stream;

separating groups from a head end of the group stream by clamping the aligned leading edge zones of superimposed articles and accelerating the clamped articles; and wherein the lateral arrangement of the articles in each group is such that:

an article bisecting line, that runs parallel to the direction of group stream travel, of at least some of the articles does not coincide with the same bisecting line of all other articles within the same group; and the lateral edges of at least some of the articles in each group are not aligned with the lateral edges of all of the other articles in the group.

2. The method according to claim 1, wherein the articles in the supply streams to be combined comprise sizes and/or shapes differing from one another.

3. The method according to claim 1, wherein, of the superimposed streams in the group stream, one part comprises leading article edge zones positioned on a lower stream surface and one part comprises leading article edge zones lying on a top surface of the stream.

4. The method according to claim 1, wherein a lateral displacement of the articles in the groups is adjustable in dependence of the article thickness.

5. The method according to claim 1, wherein the group stream is pressed upstream of its head end.

6. The method according to claim 5, wherein the group stream is pressed at pressing points, said pressing points being spaced from one another in the conveying direction, the pressing points being moved together with the group stream, wherein the distances between the pressing points are equal to the distance between the articles in the superimposed streams of the group stream.

7. The method according to claim 5, wherein the group stream is pressed at pressing points, said pressing points being spaced from one another transverse to the conveying direction, wherein the pressing points are adjustable transverse to the conveying direction in dependence of positions of article edges.

8. The method according to claim 1, wherein the leading edge zones at the head end of the group stream are clamped at clamping points, said clamping points being spaced from one another transverse to the conveying direction.

9. The method according to claim 8, wherein the clamping points are adjustable transverse to the conveying direction in dependence of article widths.

* * * * *